US005813274A

United States Patent [19]

Strong et al.

[11] Patent Number: 5,813,274

[45] Date of Patent: Sep. 29, 1998

[54] MAGNETIC PRESS

[75] Inventors: Michael David Strong, Mechanicsburg; Michael Anthony Yeomans, Camp Hill, both of Pa.

[73] Assignee: The Whitaker Corporation, Wilmington, Del.

[21] Appl. No.: 717,373

[22] Filed: Sep. 20, 1996

[51] Int. Cl.[6] ..... B21J 15/24

[52] U.S. Cl. ..... 72/430; 72/707; 100/256

[58] Field of Search ..... 72/707, 430; 100/256

[56] References Cited

U.S. PATENT DOCUMENTS

| | | | |
|---|---|---|---|
| 2,876,452 | 3/1959 | Herman et al. . | |
| 2,951,437 | 9/1960 | Diener | 100/256 |
| 3,055,250 | 9/1962 | Hubbard | 72/430 |
| 3,343,398 | 9/1967 | Kerns | 72/413 |
| 3,584,496 | 6/1971 | Keller | 72/430 |
| 3,783,662 | 1/1974 | Keller et al. | 72/430 |
| 3,883,839 | 5/1975 | Barrett et al. | 338/116 |
| 4,022,090 | 5/1977 | Doherty et al. | 72/430 |
| 4,081,774 | 3/1978 | Barrett et al. | 335/228 |
| 4,703,644 | 11/1987 | Waldner | 72/707 |
| 4,926,677 | 5/1990 | Waldner | 72/707 |
| 5,113,736 | 5/1992 | Meyerle | 72/430 |
| 5,131,124 | 7/1992 | Skotek | 29/33 M |
| 5,197,186 | 3/1993 | Strong et al. | 29/863 |
| 5,325,699 | 7/1994 | Stuart | 72/347 |
| 5,502,996 | 4/1996 | Strong et al. | 72/707 |

FOREIGN PATENT DOCUMENTS

| | | | |
|---|---|---|---|
| 2 192 908 | 2/1974 | France . | |
| 469327 | 11/1952 | Italy | 72/430 |
| 59-086207 | 5/1984 | Japan . | |
| 59-124105 | 7/1984 | Japan . | |
| 04336402 | 11/1992 | Japan . | |
| 0223120 | 12/1994 | Japan | 72/430 |
| 402411 | 10/1973 | U.S.S.R. | 72/707 |
| 1197765 | 10/1984 | U.S.S.R. | 72/430 |
| WO 89/08936 | 9/1989 | WIPO . | |

*Primary Examiner*—David Jones
*Attorney, Agent, or Firm*—Marshall E. Rosenberg

[57] ABSTRACT

A magnetic press (10) for performing a manufacturing operation includes tooling (60) operatively connected to reciprocating parts comprising rods (22), and a magnet (41) connected to the rods (22) through a stationary plate (31). A control circuit (200) electrically operates a reciprocating magnet (41) and a stationary magnet (51) for inducing flux fields of attraction in the magnets (41,51), and for reversing the polarity of the flux fields to eliminate residual magnetism and for cushioning the landing of magnet (41) on a return stroke. FIGS. 2 and 4.

23 Claims, 5 Drawing Sheets

MAGNETIC PRESS

The present invention relates to a magnetic press for use with a manufacturing operation, for example, the termination of electrical terminals to electrical wires, and, more particularly, to control of the termination cycle of the press by a control circuit that eliminates inter-cycle, residual magnetic flux between the electromagnets of the press thereby minimizing the required cycle time per termination.

BACKGROUND OF THE INVENTION

Presses for terminating electrical terminals to wires typically employ linear pneumatic or rotary electric actuators to provide the forces necessary for crimping a terminal to a wire. Because these actuators are often energy inefficient, difficult to control from a quality standpoint, and are particularly susceptible to maintenance problems, a distinct group of presses employing the use of electromagnets has been developed. In a general design scheme of such magnetic presses, a pair of electromagnets is connected to an electrical circuit, which circuit is operative to supply electrical current to the magnets' windings in a way that induces attractive magnetic fields. One of the magnets is operatively connected to a displaceable shaft which transmits forces to a crimping tool, which, in turn, transmits crimping forces to a terminal thereby crimping the terminal to an electrical wire. Magnetic presses are advantageously capable of generating compressive forces in the order of several tons of crimping pressure, but problems have arisen regarding the control of such forces.

Prior devices which address the control of magnetic presses of the foregoing design are disclosed in U.S. Pat. Nos. 3,584,496('496) and 3,783,662('662). Referring first to the '496 patent, two circuits are therein described. The first circuit defines an embodiment applying a pulse of current from a power source to the windings of a pair of magnets One of the magnets is stationary, and the other magnet is reciprocable and is attached to a tooling shaft. The pulse has been predefined in current and amplitude based on prior experience with a particular work piece. The circuit does not provide for a sensor or feedback system to control the current sent to the magnets. The second circuit results in application of a constant crimp force through the use of a feedback system including a force transducer, e.g. a piezoelectric device or strain gauge. The force transducer is strategically placed to sense the force applied to an anvil of the crimp tooling. The force transducer is operative to send a proportional electrical signal to a comparator which compares the transducer signal to a reference signal, if there is a differential between the signals, the comparator then sends a control signal to the power source to modify the power input to the magnets until the transducer signal sufficiently approximates the reference signal. A timing circuit then controls the interval of time, i.e. the dwell time, that the crimping force is applied to the terminal, which time is equal to a predetermined interval of time. At the end of the dwell time, the terminal has been crimped, the magnets are de-energized, and the reciprocable magnet is returned, under a spring force, to an original position in preparation for the next crimp cycle.

The device described in the '662 patent is an improvement over the '496 device in that a let down circuit has been added for the purpose of limiting the initial current to the magnets, thereby controlling the velocity of the crimp tooling and avoiding excessive kinetic energy in the tooling on the down stroke. After the tooling makes the initial contact with a work piece, the current supplied to the magnets is increased for generating sufficient crimping forces. A transducer/comparator circuit, such as described above in respect of the '496 patent, is used to control the force applied during the dwell time. When the reference signal is met by the transducer signal value, the power to the magnets is cut off, and the reciprocating magnet returns to an undisplaced position in preparation for the next cycle.

A disadvantage of the foregoing magnetic presses is that magnetic flux fields exist between the magnets even after the power signal to the magnets has been zeroed. This occurs because the electromagnetic material does not return to its original state, i.e. an insubstantial magnetic flux, but, rather, after removal of the circuit induced magnetic field a residual magnetism inheres in the electromagnetic material. Such residual magnetism results in a continuation of the forces of attraction between the magnets, thereby retarding their relative separation in preparation for the next crimp cycle, and, thereby disadvantageously resulting increased cycle time. Moreover, the use of a transducer to sense the pressure of the crimp tooling and send a control signal to a comparator for processing adds delay in response time of the overall control system. Furthermore, the use of a transducer increases the capital equipment and maintenance expenses of the prior devices. Additionally, when the magnet is returned under the force of the spring the magnet will tend to come to an abrupt stop, i.e. slam, into an abutment on the up-stroke thereby potentially damaging the component parts of the press. A further disadvantage of the prior devices is that they are not adapted to receive standard application tooling with an automatic terminal feed mechanism.

In view of the above, what is needed is a magnetic press which has a minimum cycle time, avoids slamming on the up-stroke, is adapted to receive standard application tooling with an automatic terminal feed mechanism, and is inexpensive to manufacture.

DETAILED DESCRIPTION OF THE INVENTION

Figure 1:
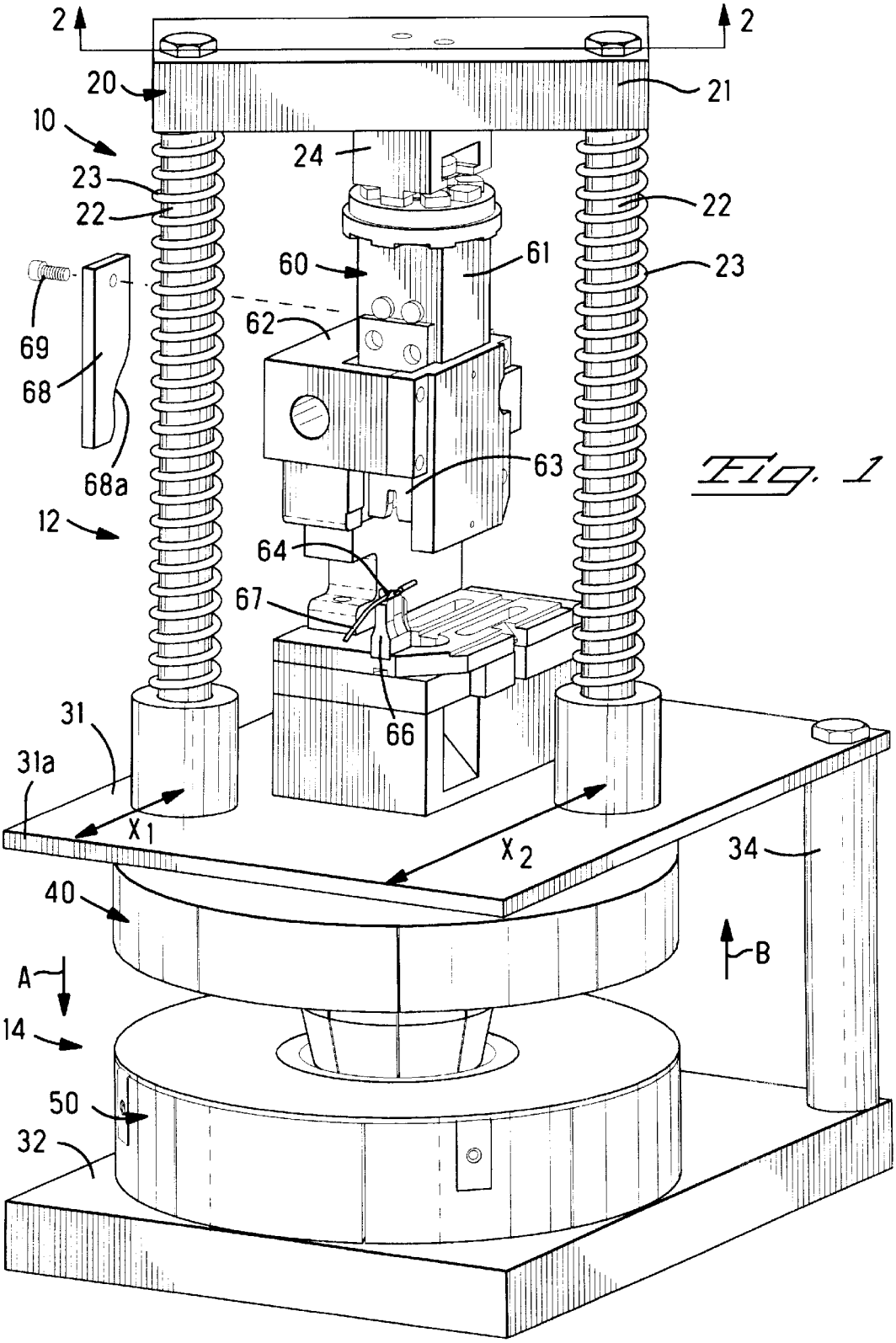
FIG. 1 is an isometric view of the magnetic press according to the present invention.

As shown in FIG. 1, magnetic press 10 comprises a terminating or operating section 12 for crimping a terminal to a wire, and a force generating section 14 comprising electromagnets which generate the crimping forces necessary for the press 10 to crimp the terminal to the wire. Additionally, magnetic press 10 is controlled by a control circuit 200 shown in FIG. 4, which will be fully described below.

Terminating section 12 includes reciprocating parts 20, and crimp tooling 60. Reciprocating parts 20 and tooling 60 are mounted generally above a stationary upper plate 31, which plate is preferably formed of a non-ferromagnetic material, e.g. aluminum. Reciprocating parts 20 include a head plate 21 rigidly connected to reciprocating rods 22 by bolts 26, and the rods have helical springs 23 therearound for spring biasing head plate 21 during operation of tooling 60. Crimp tooling 60 is a standard applicator type tool, for example, a Mini Quick Change Applicator terminal applicator made by AMP Incorporated of Harrisburg, Pa.; however, it is to be understood that other tooling can be used with the present invention as well. Tooling 60 is operatively connected to head plate 21 by ram adapter 24, and comprises a ram 61 which is slideably mounted, along a first line of action, in a stationary ram housing 62. Ram 61 is arranged to forcibly displace crimp tool 63 against a terminal 64 disposed on a wire 67 disposed above anvil 66 for crimping the terminal 64 to a wire 67. Tooling 60 further includes a conventional cam plate 68 having a cam side 68*a* for driving a terminal feed mechanism, not shown, on a down stroke of ram 61. Cam plate 68 is connected to ram 61 by fastener 69 for reciprocating movement therewith so that cam side 68*a* is directed toward anvil 66, but it is to be understood by persons of ordinary skill that cam side 68*a* can be relocated to the top of cam plate 68, to thereby drive a terminal feed mechanism on the up stroke as well. The force needed to drive the feed mechanism is about 175 lbs on the up or down stroke.

In an advantage of the present invention, tooling 60 is mounted between rods 22 such that tooling 60 can accommodate side or end feed type terminal applicators. Rods 22 are mounted slightly askew on plate 31 because of the differential between distances $X_1$ and $X_2$, which distances are defined between a front face 31*a* of plate 31 and respective centers of rods 22. Thus a side feed mechanism can be mounted to the left hand side of tooling 60 as shown in FIG. 1.

Force generating section 14 comprises an upper magnet assembly 40, which is rigidly attached to rods 22, and a lower magnet assembly 50, which is rigidly attached to plate 32. During the crimp cycle, the upper magnet assembly 40 is reciprocable in a power or down stroke direction indicated by arrow A, and a return or upstroke direction indicated by arrow B, as will be further described hereinbelow. Plate 31 is rigidly supported by a pair of corner columns 34 (only one is shown in the Figures), and a central column 35, as is best shown in FIG. 2.

Figure 2:
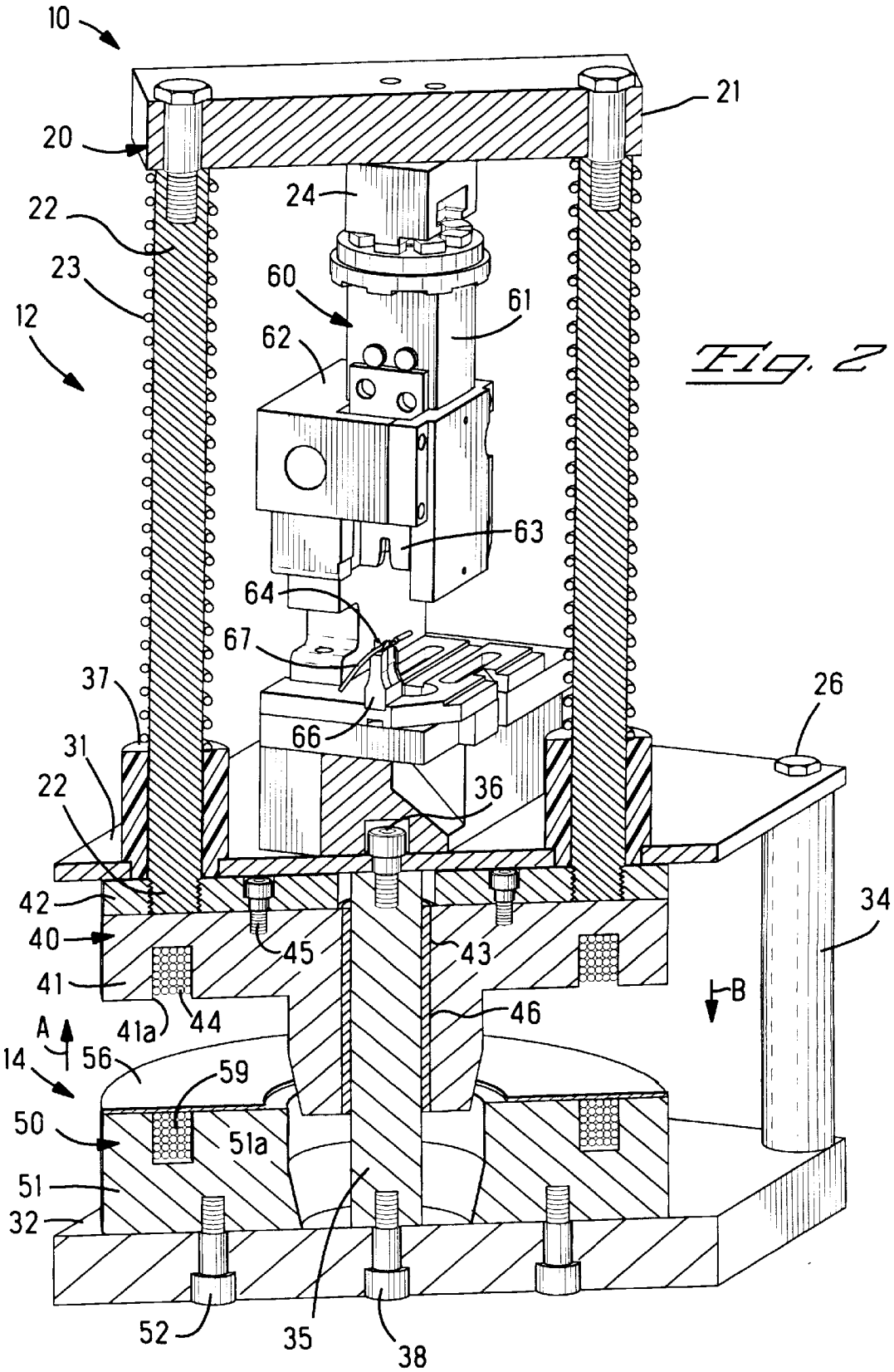
FIG. 2 is a cross sectional, isometric view of the magnetic press of FIG. 1 taken along line 2—2.

FIG. 2 describes the present invention in more detail by showing a cross sectional view of the press of FIG. 1 taken along line 2—2. The head plate 21 is connected to rods 22 by threaded bolts 26, which bolts are threaded to threaded apertures in rods 22, thereby rigidly connecting rods 22 to head plate 21. Rods 22 are slideably reciprocable through bushings 37, which are preferably of a nylon type. Bushings 37 are inserted into apertures of upper plate 31, and rods 22 reciprocate therethrough along respective second lines of action offset from the first line of action of ram 61. Rods 22 are connected to respective threaded connections 27 in a steel plate 42. As described above, upper plate 31 is supported by and is rigidly connected to a central column 35 and a pair of essentially identical corner columns 34, only one of the columns 34 being visible in the Figures. A fastener 36 connects plate 31 to central column 35, and fasteners 26 connect upper plate 31 to corner columns 34. Lower plate 32 is likewise rigidly connected to central column 35 by a fastener 38, and lower plate 32 is rigidly connected to corner columns 34 by fasteners (not shown).

Figure 3:
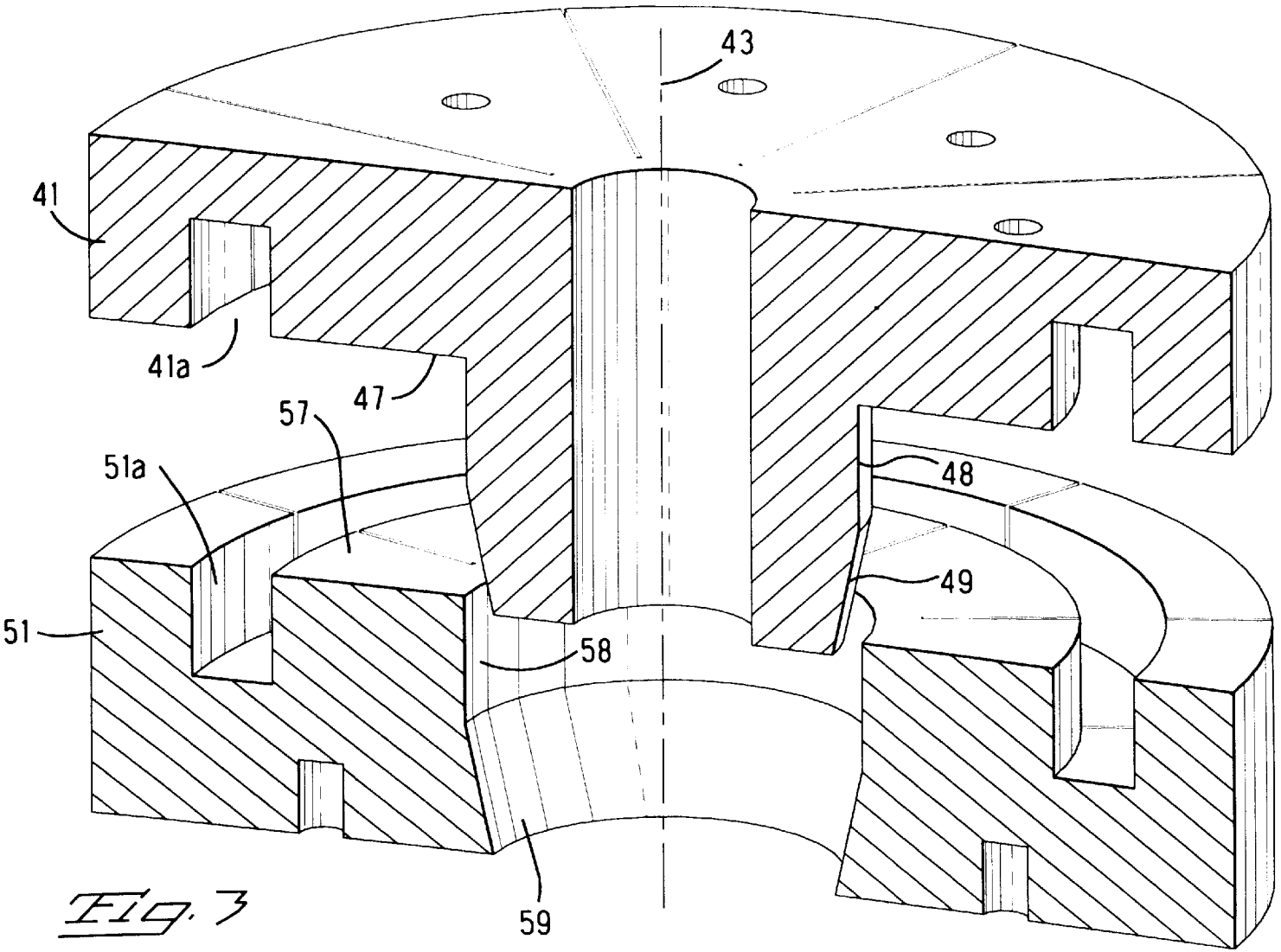
FIG. 3 is a cross sectional, isometric view of the magnets shown in FIGS. 1 and 2.

Referring to FIGS. 2 and 3, upper magnet assembly 40 includes an electromagnet 41 having a winding receiving recess 41*a* therein for receiving magnet windings 44. Windings 44 are electrically connected to a control circuit, as will be described below. Magnet assembly 40 also includes steel plate 42 which is rigidly connected to rods 22, and plate 42 is rigidly fastened to magnet 41 by fasteners 45. A central bore 43 of magnet 41 has a bushing 46 disposed therein, preferably of an oil impregnated brass material, for slidingly receiving column 35 therethrough, thereby guiding magnet 41 during its reciprocating movement along column 35.

Base magnet assembly 50 includes an electromagnet 51 which is rigidly attached to base plate 32 by fasteners 52. Magnet 51 includes windings 54 disposed in recesses 51*a*, and a brass plate 56 centrally placed over the top of the magnet for separating the magnets 41,51 during the down stroke of the crimp cycle and for absorbing shock when the magnets are in close proximity on the down stroke of magnet 41.

In the preferred embodiment, magnets 41,51 define a pair of nesting conical magnets, as is best shown in FIG. 3, and are preferably formed of a low carbon steel material. Magnet 41 comprises a flat section 47, a cylindrical section 48, and a frusto-conical section 49 directed toward lower magnet 51, which sections are coaxial with an axis running through central bore 43. Lower magnet 51 comprises complimentary flat, cylindrical, and frusto-conical sections 57,58,59, respectively. Flat sections 47,57 provide a high magnitude vertical force component at small separations. Frusto-conical section 49, because it is more closely spaced to magnet 51 at the largest separation of the magnets, provides a vertical force component sufficient to overcome the initial mechanical inertia of the press and the spring forces of springs 23, and provides the forces required to feed a terminal feed mechanism. In general, where completely flat magnets are close to each other, the attractive forces are of a high magnitude, but the required stroke length of the present invention separates magnets 41,51 to the point that the attractive forces of flat sections 47,57 are too weak to initiate the crimping cycle. Therefore, the vertical component of force provided by the frusto-conical section 49 is important because it bootstraps the motion of magnet 41. This eliminates the need for a supplemental power source, e.g. an air cylinder, to initially bring magnet 41 toward magnet 51 to the point where the attractive forces of flat sections 47,57 would otherwise be sufficient to initiate the crimp cycle.

Figure 4:
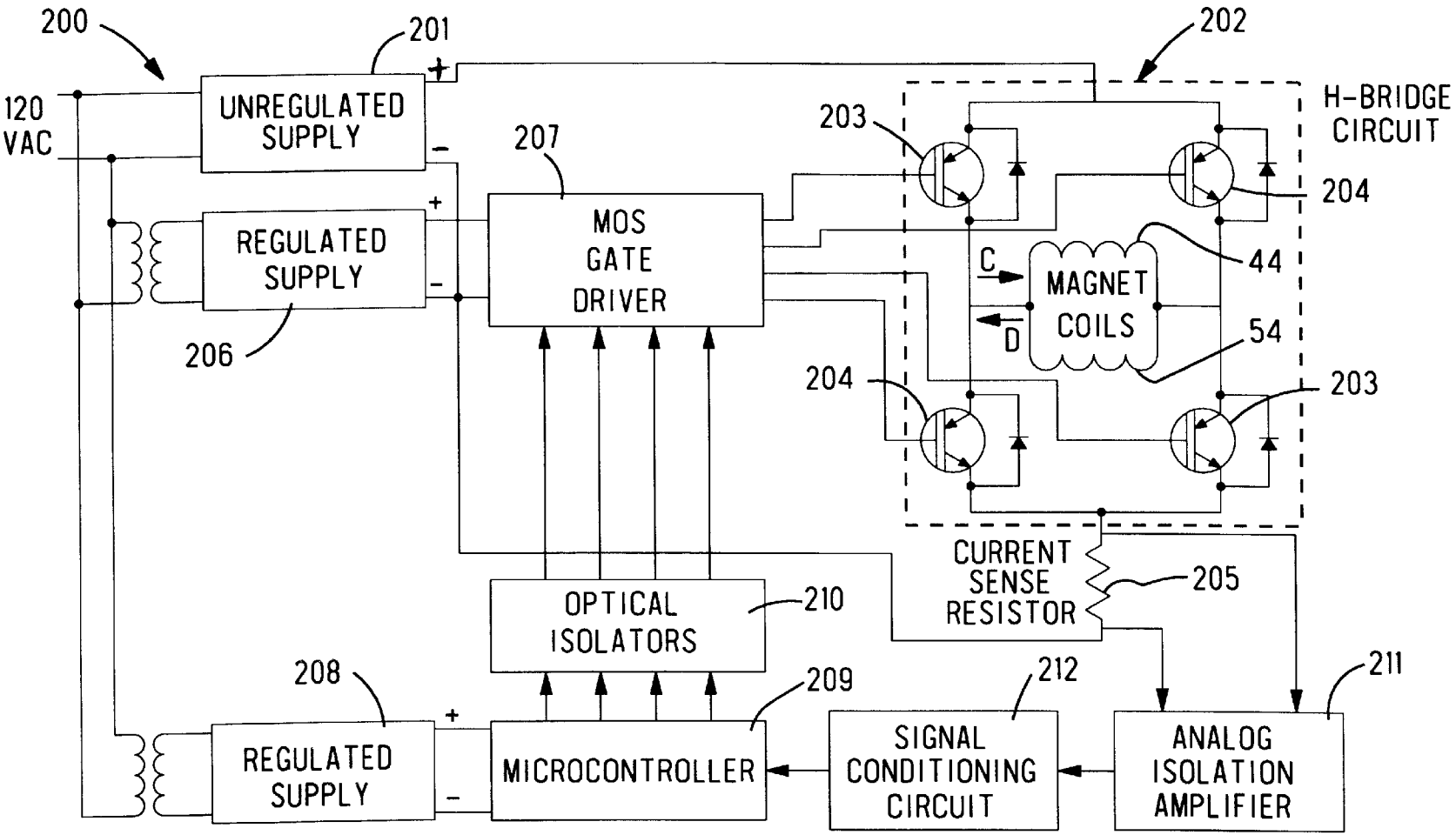
FIG. 4 is a diagram of the control system of the present invention.

FIG. 4 shows a control circuit 200 and the components of the control system which effectuate control of an H-bridge 202 circuit therein. These components comprise: an unregulated voltage supply 201; the H-bridge 202 with transistors 203,204; magnet coils 44,54 of magnets 41,51, respectively; a current sense resistor 205; a MOS gate driver regulated voltage supply 206; a MOS gate driver 207; a microcontroller regulated supply 208; a programmable microcontroller 209 which includes a pulse width modulation controller (PWMC) as an integral part thereof; optical isolators 210; an analog isolation amplifier 211; and a signal conditioning circuit 212.

Unregulated supply 201 provides the high electrical power required to supply windings 44,54 of electromagnets 41,51. Additionally, unregulated supply 201, regulated supply 206, MOS gate driver 207, H-bridge 202 circuit, and current sense resistor 205 are referenced to the same ground, i.e. apart from the microcontroller regulated circuit, thereby providing optical isolation between the optical isolators 210 and the MOS gate driver 207, and between the current sensor resistor 205 and signal conditioning circuit 212. Because they are referenced to different grounds, the optical isolators 210 and analog isolation amplifier 211 together provide optical isolation between H-bridge and microcontroller sides of the circuit. The PWMC associated with microcontroller 209 is operative to control the current passing through H-bridge circuit 202 by modulating the voltage thereof through MOS gate driver 207, but it does so in accordance with commands from the microcontroller 209.

The function of the MOS gate driver 207 is to receive signals from the microcontroller 209 and the PWMC and to then activate appropriate transistors 203 or 204 of H-bridge circuit 202. When transistors 203 are activated, current flows in the direction of arrow C across windings 44,54 of magnets 41,51; alternatively, when transistors 204 are activated current flows in an opposite direction indicated by arrow D. Current flow across windings 44,54 induces magnetic flux fields about magnets 41,51, for example, to a +/− polarity; reversing the current flow direction results in a reversal of the polarity across the windings to a −/+ condition and a reversal of the polarity of the flux fields about magnets 41,51. Any current passing through windings 44,54 must pass through current sense resistor 205, causing a voltage thereacross which is sensed by analog isolation amplifier 211. Analog isolation amplifier 211 sends the voltage information in the form of an analog signal to signal conditioning circuit 212, which processes the signal for the microcontroller 209. Microcontroller 209 reads the signal as a voltage proportional to the current flowing across current sense resistor 205, reads the rate of change of the current as a characteristic of the current, compares the rate of change to a programmed value, determines that the rate of change in the signal sufficiently approximates the programmed value, and activates an H-bridge circuit. Microcontroller 209 is also operative to perform a timer function to reverse the polarity of windings 44,54 via the PWMC and MOS driver 207 at a predetermined time, i.e. when the current meets certain programmed conditions, as will be further described below.

Figure 5:
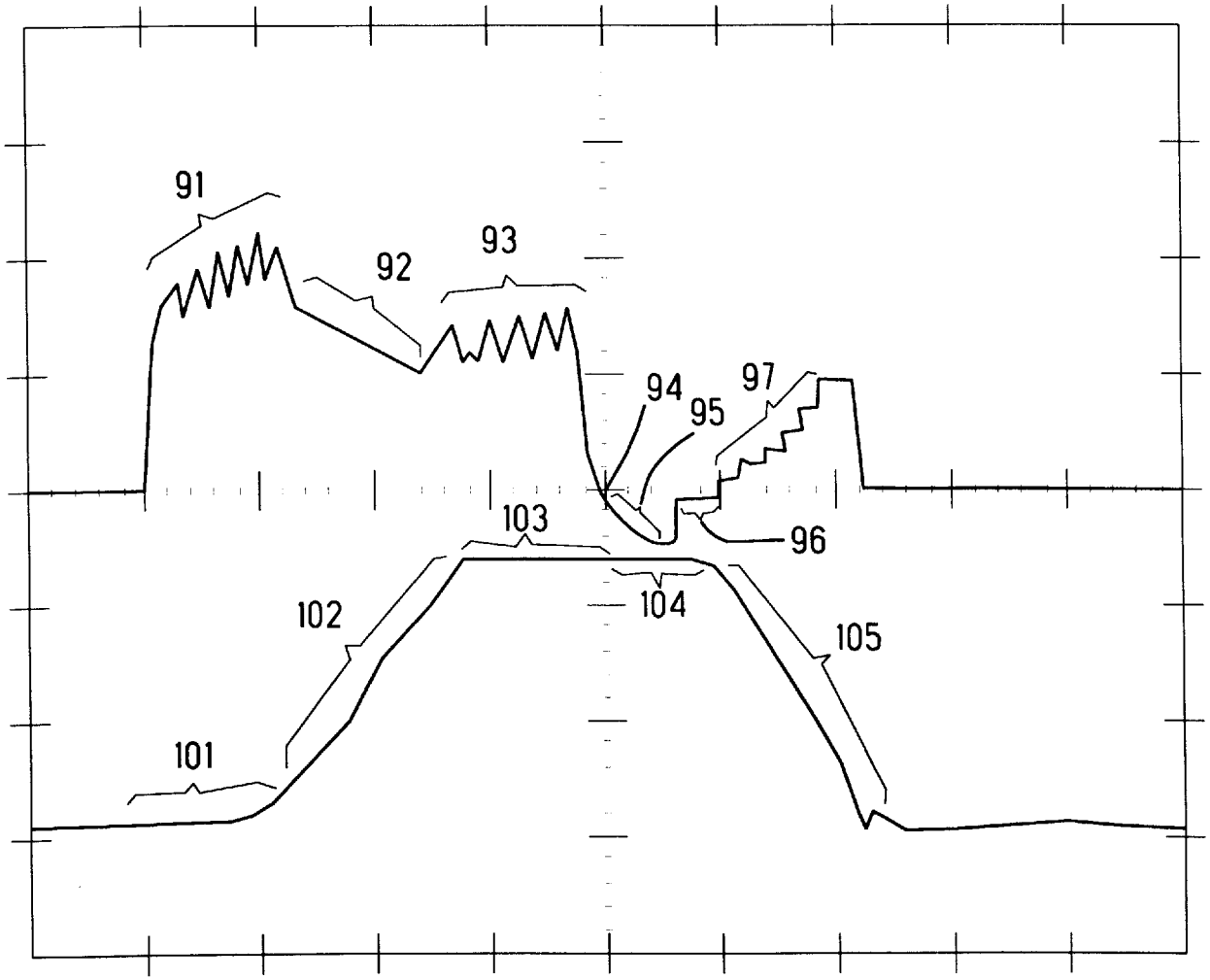
FIG. 5 is an oscilloscope trace made during a crimping cycle of the present invention depicting current as a function of time in the upper portion of the trace, and position as a function of time depicted in the lower portion of the trace.

Operation of the magnetic press according to the present invention will now be described with reference to the foregoing drawing Figures and particularly to FIG. 5, which Figure represents an oscilloscope trace of one crimp cycle of press 10. The upper portion of FIG. 6 depicts a graph of current as a function of time, i.e. i(t), and the lower portion of the Figure depicts a graph of displacement of the magnet 41 as a function of time, i.e. y(t). The graph of i(t) comprises segments 91–97, and that of y(t) comprises segments 101–105, as will be described more fully below.

At the start of the crimp cycle, microcontroller 209 commands the PWMC to bring the voltage output to magnets 41,51 via MOS gate driver 207 to a preset maximum value as indicated at segment 91 in i(t), which induces a maximum flux field of attraction in magnets 41,51. The H-bridge circuit 202 is initially set to induce a first, attractive polarity +/− with transistors 203 activated and transistors 204 deactivated, i.e. magnet 41 emits a positive flux field and magnet 51 emits a negative flux field. At this point, as described above, the mechanical inertia of the press and spring forces are beginning to be overcome due in substantial part to the vertical component of force generated by the frustoconical section 49 relative to magnet 51. Additionally, this component of force is sufficient to drive a terminal feed mechanism. Thus, magnet 41 begins to be displaced, as indicated at segment 101 in y(t).

As magnet 41 moves toward magnet 51, the powerful magnetic flux fields of flat sections 47,57 are being moved closer together resulting in less current being drawn through the magnets, thus a negative slope or rate of change appears at segment 92 of i(t). Analog isolation amplifier 211 senses this as a voltage change across current sense resistor 205, and sends a signal through signal conditioning circuit 212 to microcontroller 209. Microcontroller 209 reads i(t) and its rate of change, and then decreases the voltage output to magnets 41,51 via the PWMC, MOS gate driver 207, and H-bridge 202. While i(t) is decreasing, magnet 41 is moving toward magnet 51 in the direction of arrow B of FIGS. 1–2, thereby pulling rods 22, head plate 21, ram 61, and crimp tool 63 in the same direction, i.e. in a power stroke direction. It is important to note that mechanical energy is being stored in springs 23 as magnet 41 is being displaced toward magnet 51, and that this stored energy reaches its maximum value during the crimping of the terminal generally at segment 103 of y(t). Moreover, in addition to the energy required to compress springs 23, the magnitude of the attractive force of the magnets is designed to provide enough power to operate a terminal feed mechanism on the down stroke as well Going further, at segment 103 of y(t) the crimp tool engages terminal 64, and begins and continues to crimp terminal 64 on wire 67. However, crimping necessarily creates mechanical resistance, and an impediment to displacement of magnet 41. As this impediment is realized, magnets 41,51 electrically react by beginning to draw additional current through current sense resistor 205, as shown by the positive slope of i(t) at segment 93. Analog isolation amplifier 211 senses this, and sends a signal to microcontroller 209. Microcontroller 209 compares the rate of change to a programmed value and commands the PWMC to increase the voltage output to a preset value for a dwell time sufficient enough to effect a high quality crimp. The dwell time is generally equal to the interval of time indicated at segment 103 of y(t) and is programmed into the microcontroller 209. The crimp forces generated by magnets 41,51 during the dwell time are in the order of 4,000 to 5,000 lbs.

After the dwell time has been completed, microcontroller 209, via the PWMC and MOS gate driver 207, deactivates transistors 203 and activates transistors 204 of H-bridge circuit 202, thereby causing a reversal of polarity of the flux fields of magnets 41,51. When the polarity is reversed, i(t) passes through zero amplitude at point 94 and moves to a preset amplitude at segment 95. The result of the activation of transistors 204 of H-bridge circuit 202 is that the first polarity +/− has been reversed to a second polarity −/+, i.e. magnet 41 now emits a negative flux field and magnet 51 emits a positive flux field. In this important advantage of the invention, the reversal of polarity dissipates any residual magnetism induced in magnets 41,51, thereby lowering the cycle time as magnet 41 can be expeditiously returned to its original position, as will be further described below.

At the point corresponding to segment 104 of y(t), the stored energy of springs 23, as noted above, is at a maximum value. After the flux fields have been reversed and the residual magnetism has been dissipated, microcontroller 209 again zeroes i(t) for a time, as shown at segment 96 of i(t), so that the attractive forces between magnets 41,51 are essentially null. Now, springs 23 are free to begin and continue to force ram 61, rods 22, and magnet 41 upwardly in the direction of arrow A of FIGS. 1–2 , as shown by the negative slope of y(t) at segment 105. However, before the parts reach such positions, and in another advantage of the present invention, after a predetermined time microcontroller 209 causes the H-bridge circuit 202 to again reverse the polarity of the flux fields, from the second polarity −/+ with transistors 204 activated back to the first +/− polarity with transistors 203 activated, i.e., magnet 41 emits a positive flux field and magnet 51 emits a negative flux field. Moreover, microcontroller 209 commands a general i(t)

ramp-up in amplitude, as shown at segment 97 of i(t). Pursuant to this ramp-up in i(t), flux fields are again induced in magnets 41,51. However, in a further advantage of the invention, this latest induction of attractive flux fields has a force component directed opposite to the force component which to springs 23 created, i.e. the flux fields induced at area 97 of i(t) tend to direct magnet 41 in the direction of arrow B. This force of attraction is not enough, however, to reverse the motion of magnet 41 in the direction of arrow A, but, by posing a counterpoise to the kinetic energy of the moving parts in their return to respective original positions, this oppositely directed force cushions the landing of magnet 41. Such a cushioning effect on the return stroke avoids slamming of magnet 41 and plate 42 against upper plate 31, thereby avoiding damage to the magnet 41 and the press 10 in general. Moreover, in yet a further advantage of the invention, the spring characteristic of springs 23 is preselected to provide enough force to tooling 60 to drive a terminal feed mechanism on the return stroke. After the parts have returned to their original positions, press 10 is ready for the next crimp cycle.

Thus, while a preferred embodiment has been disclosed, it is to be understood that the invention is not strictly limited to such embodiment but may be otherwise variously embodied and practiced within the scope of the appended claims.

Accordingly, what is claimed is:

1. A press for performing a manufacturing operation, comprising an operating section having a movable plate and a tooling section with a ram movable by said movable plate in power and return strokes over an anvil, and a force generating section connected to said operating section for supplying forces to perform the manufacturing operation, said press further comprising:

(a) said force generating section comprises a first set of force generating members, said first set of force generating members comprise first and second electromagnets having separate electrical windings which are part of a press control circuit, said first electromagnet is connected to said operating section and said second electromagnet is fixed with respect to said anvil for supplying forces to said tooling section during activation of said press control circuit;

(b) said operating section comprises a second set of force generating members; and (c) said tooling comprises a feed mechanism interface, said first and second sets of force generating members provide sufficient force to the tooling to drive the power and return strokes of the ram and to drive the feed mechanism interface.

2. The press of claim 1, wherein said second set of force generating members comprise biasing members for driving said return stroke and said feed mechanism interface.

3. The press of claim 2, wherein said biasing members comprise springs.

4. The press of claim 1, wherein said second set of force generating members comprise movable rigid members, said rigid members are operatively connected to biasing members and said tooling for driving said return stroke and said feed mechanism interface.

5. The press of claim 1, wherein said at least one magnet moves relatively away from said anvil during said power stroke.

6. The press of claim 1, wherein said at least one electromagnet comprises an aperture therein, and is movable during said power and return strokes relative to a guide member in said aperture.

7. The press of claim 6, wherein said guide member comprises a stationary shaft.

8. The press of claim 1, wherein said at least one electromagnet and said ram move in respective lines of action during said power and return strokes on opposed sides of said anvil.

9. A press for performing a manufacturing operation comprising an operating section having a tooling section with a ram movable in power and return strokes during cycles of the manufacturing operation, and a force generating section connected to said operating section for supplying forces to perform the manufacturing operation, said press further comprising:

(a) said force generating section comprises electromagnets;

(b) said operating section comprises a set of force generating members;

(c) a press control circuit operatively connected to said electromagnets for controlling said electromagnets by inducing respective magnetic flux field polarities about said magnets;

(d) at least one electromagnet is connected to said operating section for supplying forces to said tooling section during activation of said press control circuit; and (e) said press control circuit comprises a component which is operative to reverse the polarities of said electromagnets for minimizing the cycle time of the manufacturing operation.

10. The press of claim 9, wherein said component comprises an H-bridge circuit electrically connected to said electromagnets for reversing the polarities thereof.

11. A press for performing a crimping operation, comprising:

(a) a frame comprising first and second stationary plates, said first plate comprises an anvil mounted thereto;

(b) electromagnets operatively connected to an electrical circuit for energizing the magnets and causing at least one of the magnets to become displaced along a stroke length;

(c) said at least one magnet, having an electrical winding attached thereto for movement therewith, is connected to reciprocating parts which operate a tool for performing a crimping operation with said anvil during the stroke length; and (d) a portion of said reciprocating parts reciprocate through said first plate for performing said crimp operation.

12. The press of claim 11, wherein said portion of said reciprocating parts comprise elongated members which extend through said first plate.

13. The press of claim 12, wherein said reciprocating parts comprise a head member which spans said elongated members.

14. The press of claim 13, wherein said crimp tool is disposed within said reciprocating parts along the span of the head member adjacent to said anvil.

15. The press of claim 11, wherein said reciprocating parts comprise biasing members disposed laterally of said anvil.

16. In a press including a tool having a ram arranged for reciprocating motion through a power stroke and a return stroke for performing a manufacturing operation, a base plate and a working plate attached to and spaced from said base plate, said tool being mounted to said working plate, a force generating section for causing said ram to undergo said reciprocating motion comprising:

(1) a fixed electromagnet attached to said base plate; and (2) a movable electromagnet having a first electrical winding, disposed between said working plate and said fixed electromagnet, both said movable electromagnet and said electrical winding are movable, as an assembly, toward and away from said fixed electromagnet for effecting said reciprocating motion of said ram.

17. The press according to claim 16 wherein said fixed electromagnet includes a second electrical winding different from said first electrical winding.

18. The press according to claim 16 including a column attached to said base plate and extending upwardly through an opening formed through said movable electromagnet for guiding said movement of said movable electromagnet toward and away from said fixed electromagnet.

19. The press according to claim 18 including a pair of spaced apart guide rails extending through openings in said working plate, each guide rail having one end attached to said moveable electromagnet and the other end coupled to said ram, so that when said movable electromagnet undergoes said movement toward and away from said fixed electromagnet, said pair of guide rails slide within their respective said openings and effect said reciprocating motion of said ram.

20. The press according to claim 19 including a header plate, said other ends of said pair of guide rails being attached to said header plate and said ram being coupled to said header plate.

21. The press according to claim 16 wherein said tool includes a feed mechanism operable by said ram during said return stroke for feeding a part into said tool for performing said manufacturing operation thereon, and a spring member arranged to urge said movable electromagnet toward said working plate only during said return stroke so that said ram is forced through said return stroke, thereby operating said feed mechanism.

22. The press according to claim 21 wherein said movable electromagnet includes a frusto-conical section arranged to interact with said fixed electromagnet during the beginning of said power stroke to overcome inertia of said movable electromagnet and to compress said spring member.

23. In a press including tool having a ram arranged for reciprocating motion through a power stroke and a return stroke for performing a manufacturing operation, a base plate and a working plate attached to and spaced from said base plate, said tool being mounted to said working plate, a first force generating section for causing said ram to undergo said reciprocating motion comprising: (1) a fixed electromagnet attached to said base plate; (2) a movable electromagnet disposed between said working plate and said fixed electromagnet movable toward and away from said fixed electromagnet for effecting said reciprocating motion of said ram, a second force generating section, and a feed mechanism interface, wherein said first and second sets of force generating sections provide sufficient force to the tooling to drive the power and return strokes of the ram and to drive the feed mechanism interface.

* * * * *